US009187909B2

(12) United States Patent
Lee

(10) Patent No.: US 9,187,909 B2
(45) **Date of Patent: *Nov. 17, 2015**

(54) TILE SYSTEM

(71) Applicant: Robert G. Lee, Portland, OR (US)

(72) Inventor: Robert G. Lee, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/776,664

(22) Filed: Feb. 25, 2013

(65) Prior Publication Data

US 2013/0160639 A1 Jun. 27, 2013

Related U.S. Application Data

(63) Continuation-in-part of application No. PCT/US2010/046538, filed on Aug. 24, 2010, which is a continuation-in-part of application No. 12/186,508, filed on Aug. 5, 2008, now Pat. No. 7,793,579, application No. 13/776,664, which is a continuation-in-part of application No. PCT/US2010/046539, filed on Aug. 24, 2010.

(60) Provisional application No. 60/954,017, filed on Aug. 5, 2007.

(51) Int. Cl.

| | |
|---|---|
| ***F41H 5/02*** | (2006.01) |
| ***E04F 15/02*** | (2006.01) |
| ***F41H 1/02*** | (2006.01) |
| ***F41H 5/013*** | (2006.01) |
| ***F41H 5/04*** | (2006.01) |

(52) U.S. Cl.

CPC ..... *E04F 15/02038* (2013.01); *E04F 15/02172* (2013.01); *F41H 1/02* (2013.01); *F41H 5/013* (2013.01); *F41H 5/02* (2013.01); *F41H 5/0414* (2013.01); *F41H 5/0442* (2013.01); *F41H 5/0492* (2013.01)

(58) Field of Classification Search

CPC ..... F41H 5/0492; F41H 5/0471; F41H 1/02; E04F 15/02038; E04F 15/02

USPC ..... 89/36.02, 903, 918, 921, 36.05; 114/271; 428/911

See application file for complete search history.

(56) References Cited

U.S. PATENT DOCUMENTS

| | | | |
|---|---|---|---|
| 274,354 | A | 3/1883 | Cumming |
| 1,268,223 | A | 6/1918 | Eimer |
| 1,767,081 | A | 6/1930 | Korber |
| 3,867,239 | A | 2/1975 | Alesi et al. |
| 4,198,707 | A | 4/1980 | Haupt et al. |

(Continued)

FOREIGN PATENT DOCUMENTS

| | | |
|---|---|---|
| DE | 4005904 | 8/1991 |
| EP | 1867804 | 12/2007 |

(Continued)

OTHER PUBLICATIONS

WO2006/132582 to Burstrom dated Dec. 14, 2006.*

(Continued)

*Primary Examiner* — Reginald Tillman, Jr.
(74) *Attorney, Agent, or Firm* — Klarquist Sparkam, LLP

(57) ABSTRACT

Plural tiles are positioned in a plate-like array. The tiles have edge portions that overlap in such a way that no straight-through joints are present between abutting tiles and such that the thickness of the entire array does not substantially exceed the thickness of a single tile.

44 Claims, 9 Drawing Sheets

(56) References Cited

U.S. PATENT DOCUMENTS

| | | | | |
|---|---|---|---|---|
| 4,241,457 | A | 12/1980 | Klein et al. | |
| 4,483,020 | A | 11/1984 | Dunn | |
| 4,548,008 | A | 10/1985 | Maeda | |
| 4,633,756 | A | 1/1987 | Rudoi | |
| 4,660,223 | A | 4/1987 | Fritch | |
| 4,757,742 | A | 7/1988 | Mazelsky | |
| 4,824,624 | A | 4/1989 | Palicka | |
| 4,825,618 | A | 5/1989 | Blevins | |
| 4,848,211 | A | 7/1989 | Perry et al. | |
| 5,102,607 | A | 4/1992 | Hickman et al. | |
| 5,170,690 | A | 12/1992 | Smirlock | |
| 5,238,721 | A | 8/1993 | Nakazawa | |
| 5,333,532 | A | 8/1994 | Smirlock | |
| 5,404,793 | A | 4/1995 | Myers | |
| 5,503,795 | A | 4/1996 | Hubbard | |
| 5,515,541 | A | 5/1996 | Sacks et al. | |
| 5,636,508 | A | 6/1997 | Shaffer | |
| 5,698,149 | A | 12/1997 | Hinzmann et al. | |
| 5,735,098 | A * | 4/1998 | Kanai et al. | 52/508 |
| 5,738,925 | A | 4/1998 | Chaout | |
| 5,771,489 | A | 6/1998 | Snedeker | |
| 5,772,748 | A | 6/1998 | Hubbard | |
| 5,792,974 | A | 8/1998 | Daqis | |
| 5,804,757 | A | 9/1998 | Wynne | |
| 5,915,528 | A | 6/1999 | Shmuelov | |
| 5,996,115 | A | 12/1999 | Mazelsky | |
| 6,009,789 | A | 1/2000 | Lyons | |
| 6,035,435 | A | 3/2000 | Shih et al. | |
| 6,035,438 | A | 3/2000 | Neal et al. | |
| 6,170,378 | B1 | 1/2001 | Neal et al. | |
| 6,318,986 | B1 | 11/2001 | Hinzmann et al. | |
| 6,370,690 | B1 | 4/2002 | Neal | |
| 6,481,782 | B2 | 11/2002 | Bond | |
| 6,510,777 | B2 | 1/2003 | Neal | |
| 6,532,857 | B1 | 3/2003 | Shih et al. | |
| 6,601,497 | B2 | 8/2003 | Ghiorse | |
| 6,622,608 | B1 | 9/2003 | Faul | |
| 6,647,684 | B1 | 11/2003 | Gank | |
| 6,684,592 | B2 | 2/2004 | Martin | |
| 6,745,661 | B1 | 6/2004 | Neal et al. | |
| 6,818,275 | B2 * | 11/2004 | Guarda et al. | 428/119 |
| 6,920,817 | B2 | 7/2005 | Ravid et al. | |
| 7,067,031 | B2 | 6/2006 | deWitt | |
| 7,143,452 | B1 | 12/2006 | Rossini | |
| 7,160,052 | B2 | 1/2007 | Weiss | |
| 7,225,717 | B2 | 6/2007 | Williams | |
| 7,413,809 | B2 * | 8/2008 | Biermann et al. | 428/469 |
| 7,500,422 | B2 | 3/2009 | Mazur | |
| 7,793,579 | B1 | 9/2010 | Lee | |
| 8,087,339 | B2 | 1/2012 | Mann et al. | |
| 2003/0129025 | A1 | 7/2003 | Donovan | |
| 2007/0234458 | A1 | 10/2007 | Larsen, II | |

FOREIGN PATENT DOCUMENTS

| | | |
|---|---|---|
| JP | 08-204381 | 8/1996 |
| JP | 2007-138443 | 6/2007 |
| WO | WO 93-21492 | 10/1993 |
| WO | WO 01-51878 | 7/2001 |

OTHER PUBLICATIONS

International Search Report and Written Opinion, dated Apr. 21, 2011, issued in corresponding International Application No. PCT/US2010/046538.

International Search Report and Written Opinion, dated Mar. 28, 2012, issued in corresponding International Application No. PCT/US2010/046539.

* cited by examiner 10
35
56
57

75
62
72
61
71

35
10
58

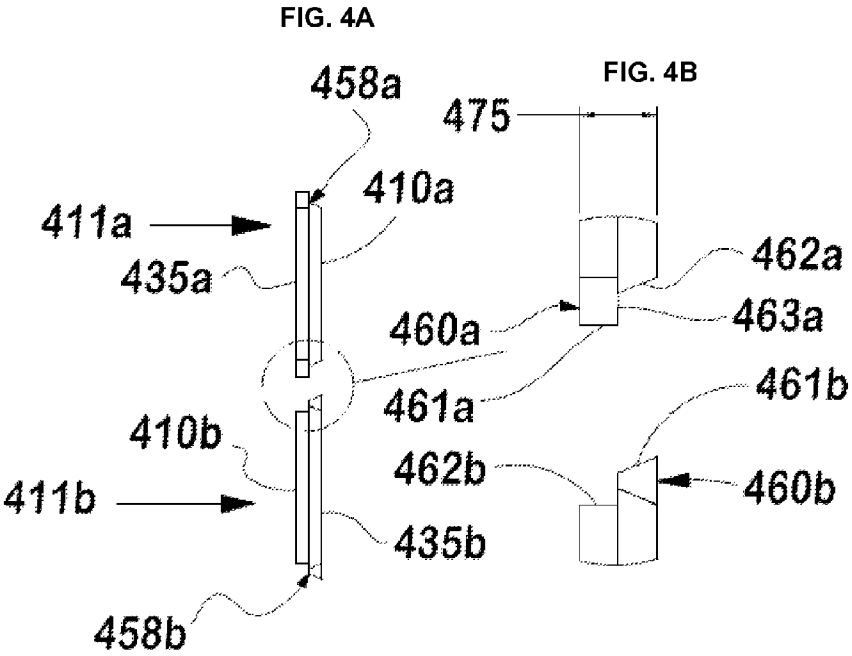
FIG. 4A
458a
410a
411a
435a
460a
461a
410b
411b
458b
462b
435b
FIG. 4B
475
462a
463a
461b
460b
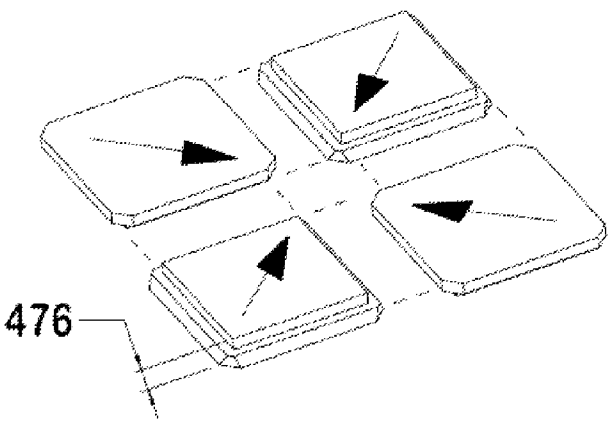
FIG. 4C
476

558a
510a
511a
535a
535b
511b
510b
558b
575
562a
560a
561a
561b
560b
562b
576

TILE SYSTEM

CROSS REFERENCE TO RELATED APPLICATIONS

This is a continuation-in-part of International Application No. PCT/US2010/046538, filed Aug. 24, 2010, which is a continuation-in-part of U.S. application Ser. No. 12/186,508, filed Aug. 5, 2008, now U.S. Pat. No. 7,793,579, which claims the benefit of U.S. Provisional Application No. 60/954,017, filed Aug. 5, 2007.

This is a continuation-in-part of International Application No. PCT/US2010/046539, filed Aug. 24, 2010, which is a continuation-in-part of U.S. application Ser. No. 12/186,508, filed Aug. 5, 2008, now U.S. Pat. No. 7,793,579, which claims the benefit of U.S. Provisional Application No. 60/954,017, filed Aug. 5, 2007.

Each of the above-referenced applications is incorporated herein in its entirety.

BACKGROUND AND SUMMARY

Arrays of tiles are used for covering surfaces. These include arrays of paving stones, roof tiles, heat shield tiles, and armor tiles. Such arrays typically have plural tiles arranged edge-to-edge generally in a common plane. Each tile typically has two opposed broad faces that are generally flat or slightly curved or arcuate and has perimeter edge surfaces.

In some applications, it is best for such tiles to have edges that can overlap in such a way that no straight-through joints are present and such that the array is plate-like with the thickness of the entire array not exceeding the thickness of a single tile. A straight-through joint, as discussed to herein, is a joint having a gap between two abutting tiles with at least a portion of the gap extending from one face of the array to the other face of the array that is normal to a face of the array. In the case of a curved array, a straight-through joint is a gap with at least a portion of the gap extending radially in a straight line between two abutting tiles at about 90° to a tangent where the tangent touches a curved face of the array.

Some approaches to avoiding straight-through joints have disadvantages. These include systems having tiles that overlap in the manner of fish scales and systems wherein seam sealers are placed over joints where tiles abut. Arrays made from such tiles cannot have a generally continuous outwardly facing surface because the outwardly facing surfaces of all the tiles are not in alignment. When tiles overlap in the manner of fish scales or seam sealers are used, there typically is excess weight, bulk, and added material expense to cover a given area. Example overlapping tile arrays having lap joints are shown in U.S. Pat. No. 1,268,223 (Eimer) and U.S. Pat. No. 6,35,777 (Neal). The weight penalty of such fish scale overlap designs can be 25% to 30%.

Monolithic tiles can be used when the coverage area is sufficiently small. But is impractical to cover a large area with a single tile, particularly if the tile is to be composed of a hard, brittle material such as a ceramic material. Such tiles are fragile and develop sharp, linear cracks propagating from the point of origin of a projectile hit through the thickness to the outer edges, so that a projectile hit typically damages the entire tile.

Tiles having edges with undercuts and/or groves sometimes have been used to address the straight-through joint gap problem, but are impractical to produce economically in high volume from hard materials. An example of tiles having undercut edges is shown in U.S. Pat. No. 5,404,793 (Meyers).

As used herein, the term "undercut" refers to any tile surface feature that makes it impossible to eject a part from a uniaxial die by simple linear displacement. An example of an undercut is a recess, groove, channel, or wall surface that extends radially inwardly from an edge of a part toward the axis of a punch of a die in which the part is formed and that blocks ejection of the part by simple linear displacement.

Described herein are tiles that have major and minor surface faces and edge surfaces that do not have undercuts relative to such an axis. In particular, such tiles do not have any recess, groove or channel that extends radially inwardly from an edge surface toward an axis that extends normal to at least one of the surface faces.

A chamfer is provided at each corner of the tile at the major surface face to permit a ledge of one tile to overlap a ledge of an abutting tile when placed in an array. Due to the presence of the chamfers, the perimeter of the major surface face generally is an irregular or regular octagon. The corners of the minor surface face need not be chamfered.

In particular, the major surface face is defined by an octagonal edge at the perimeter of the major surface face. The edge consists of eight edge portions extending between the corners of the octagonal edge. The edge portions at each corner extend at an internal angle of about 135° relative to each other. The minor surface face is square or otherwise rectangular and is defined by a rectangular edge that consists of four edge portions. Four edge surfaces extend between the four edge portions of the minor surface face and the perimeter of the major surface face. One or more of the edge surfaces and a portion of the major surface face define one or more laterally extending ledges.

Such tiles can be arranged in an array with the ledges of one tile overlapping ledges of abutting tiles to avoid straight-through joints. The edge surfaces are shaped such that the edge surface of the one tile generally conforms to the edge surface of the other tile when the pair of tiles is positioned edge-to-edge. The major and minor surface faces of the one tile generally align respectively with the minor and major surface faces of the other tile and with an edge surface of the one tile overlying an edge surface of the abutting tile, when viewed facing normal to surface faces of the tiles, with only a portion of the thickness of each tile overlapping so that the face-to-face thickness of the pair of tiles where they overlap is no greater than the distance between the major and minor surface faces of one of the tiles.

In some arrangements, all the tiles are identical in shape with abutting tiles inverted so their facing perimeter ledges mate when in an array. In other arrangements, arrays are built from two or more different styles of tiles that are not of identical shape but that have mating perimeter ledges.

Because the ledge of one tile overlaps the ledge of an abutting tile, no grout or filler is required between mating edge surfaces. Such filler systems add cost, have maintenance issues, and can cause catastrophic system failures such as failure of the space shuttle Columbia heat shield tiles where grouting material between tiles came out and allowed heat penetration.

Arrays formed from tiles described herein can be held in place by attachment to a substrate by adhesives. Or tiles can be contained in fabric wraps to hold arrays in place.

Tile systems described herein will find application in many different fields including, but not limited to armor tiles for body armor, armor systems for non-body armor such as vehicles, airplanes helicopters and wherever ballistic and blast protection is needed, heat shields, patio floor tiles, bath tiles, cabinet tiles, roof tiles, building tiles, and in other architectural applications. An array of tiles can provide a barrier for inhibiting penetration of ballistic projectiles such as an array of tiles in a body armor garment configured to be worn by a human.

For some applications, the entire major and/or minor surface face of a tile described herein can be slightly curved or arcuate, having a radius of curvature of 4 inches or more.

The major and/or minor surface faces can have texture, such as a series of curved or angular projections, to turn impinging projectiles to reduce or eliminate the effect of 90° projectile impacts, which have the greatest potential for penetration or cracking destruction of an armor tile.

The major and/or minor surface faces may be textured to provide a decorative effect.

BRIEF DESCRIPTION OF THE DRAWINGS

In the drawings:

FIG. 3*a* is an enlarged partial side elevational view of edge portions of the tiles shown in FIG. 3*a*.

FIG. 4*a* is a side elevational view of an array of two non-identical tiles with the tiles shown aligned edge-to-edge with their respective major and minor surface faces facing in opposite directions.

FIG. 4*b* is an enlarged parital side elevational view of facing edge portions of the tiles shown in FIG. 4*a*.

FIG. 4*c* is an oblique view of an array of two of each of the tiles shown in FIG. 4*a* aligned edge-to-edge with the two types of tiles having their respective major and minor surface faces facing in opposite directions.

DETAILED DESCRIPTION

Figure 1A:
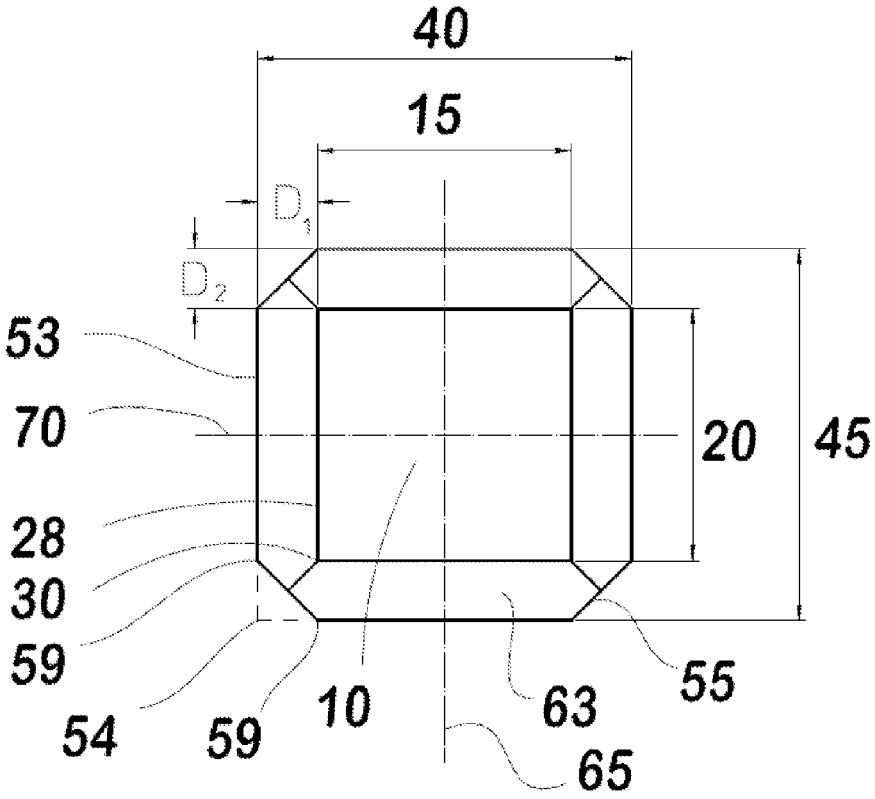
FIG. 1*a* is a front elevational view of a tile suitable for use in forming an array of tiles.

Described herein are tiles that generally have the shape of a frustum of a pyramid. Each tile has major and minor bases or surface faces having perimeters that are generally rectangular, with the length of the sides of the rectangle being the same for both the major and minor surface faces, and four edge surfaces that are profiled to provide laterally extending perimeter ledges.

The ledges are configured such that an array of tiles can be formed by aligning tiles edge-to-edge with abutting tiles having their respective major and minor surface faces facing in opposite directions. The edge surfaces are shaped so that the major and minor surface faces of one tile generally aligns respectively with the minor and major surface faces of an abutting tile and with an edge surface of the one tile overlying an edge surface of the abutting tile, when viewed facing normal to surface faces of the tiles, with only a portion of the thickness of each tile overlapping so that the face-to-face thickness of a pair of tiles positioned edge-to-edge is no greater than the distance between the major and minor surface faces of one of the tiles. The edge surfaces are shaped such that the edge surface of one tile generally conforms to the edge surface of another tile when the pair of tiles is positioned edge-to-edge with abutting tiles in inverted orientation such that the major and minor surface faces of the one tile generally are aligned respectively with the minor and major surface faces of the abutting tile.

An array of such tiles can have close fitting seams between the tiles. Straight-through joints are avoided. And depending on how the tiles are secured in place, abutting tiles can tilt to some extent relative to each other so that an array can be somewhat flexible at joints between abutting tiles.

FIGS. 1 and 3*a*-3*e* illustrate an advantageous tile having certain characteristics including:

a minor surface face 10
a minor surface width 15
a minor surface length 20
a minor surface depth 25
a minor surface perimeter 28
minor surface corners 30
a major surface face 35
a major surface width 40
a major surface length 45
a major surface depth 50
a major surface perimeter 53
chamfer surfaces 55
major surface face corners 59
a ledge 60 a vertical center line 65
a horizontal center lines 70
a total tile thickness 75
a ledge surface angle 80
a ledge surface thickness 85

Common Characteristics

All the tiles described herein have certain common characteristics, illustrated by the tile shown in FIGS. 1*a*, 1*b*, and 3*a*-3*e* (and in other figures wherein like elements are designated by reference numbers wherein the last two digits are the same as those shown in shown in FIGS. 1*a*, 1*b*, and 3*a*-3*e*), including the following.

The minor surface face 10 has a smaller area than the major surface face 35.

Edge surfaces extend between the perimeter 28 of the minor surface face 10 and the perimeter 53 of the major surface face 35.

Edges of the minor surface perimeter 28 meet at each minor surface corner 30 at an internal angle about 90° as viewed facing normal to the minor surface face 10. The minor surface face perimeter 28 is rectangular or substantially rectangular and can be square or substantially square.

The major surface face perimeter 53 has four truncated corner or chamfer surfaces 55, one at each corner of the ledge 60. The chamfers permit the major surface perimeter 53 to fit alongside the corresponding minor surface face perimeter 25 of an abutting tile when the ledges of inverted abutting tiles overlie one another. Adjacent edges of the major surface perimeter 53 meet at an internal angle about at 135° as viewed facing normal to the major surface face 35. The major surface perimeter 53 thus is substantially octagonal, either an irregular octagon or a regular octagon. The octagon has eight edge portions with each pair of adjacent edge portions extending from a corner 59 at an internal angle of about 135° relative to each other.

As viewed facing normal to the minor surface face 10 as in FIG. 1*a*, each chamfer surface 55 is the hypotenuse of a right triangle. The lengths of the other two legs of the triangle are distances $D_1$, $D_2$, which are the distances from the major surface perimeter 53 to the minor surface face perimeter 28 measured along lines extending perpendicular to edge portions of the perimeter 28 viewed facing normal to the minor surface face 10 as shown in FIG. 1*a*. The distance $D_1$ is the difference between the minor surface face width 15 and the major surface width 40 divided by 2. The distance $D_2$, which is equal to the distance $D_1$, is the difference between the minor surface face length 20 and the major surface length 45 divided by 2. In other words, as viewed facing normal to the minor surface face 10 as in FIG. 1*a*, the distance between a side edge portion 56 of the perimeter of the major surface face 35 and the nearest edge portion of the perimeter 28 of the minor surface face 10, as measured normal to the edge portions, is the same at each edge of the four side edge portions 56 of the perimeter of the major surface face.

EXAMPLES

FIGS. 1 and 3*a*-3*e* show a tile that is a body having a hexagonal base surface or major surface face 35 and a square apex surface or minor surface face 10 with the major and minor surface faces generally everywhere equidistant. Lateral faces or edge surfaces 58 extend from the minor surface face 10 to the major surface face 35, with the edge surfaces generally flaring progressively without any grooved or otherwise undercut portion.

A chamfer is provided at each corner of the tile at the major surface to permit a ledge of one tile to overlap a ledge of an abutting tile when placed in an array. Due to the presence of the chamfers, the perimeter of the major surface face is generally an irregular or regular octagon. The perimeter thus consists of eight edge portions. In particular, the tile of FIGS. 1 and 3*a*-3*e* has four side edge portions 56 and four chamfer edge portions 57, the side and chamfer edge portions alternate progressively around the perimeter with adjacent side and chamfer edge portions extending at an internal angle of about 135° relative to each other. In the illustrated tile, all the side edge portions 56 are of about the same length 40, 45 and the two pairs of facing side edge portions 56 extend at internal angles of about 90° relative to each other, so that the internal angle at each corner 54 of the perimeter of the minor surface face is about 90°.

The minor surface face 10 and the major surface face 35 are substantially planar and extend substantially in parallel to one another. The tile thus has a total thickness 75 that is generally uniform as measured anywhere between the minor surface face 10 and major surface face 35 along a line normal to the surfaces. The minor surface face 10 has a smaller area than the major surface face 35 and is positioned such that the perimeter 28 of the minor surface face does not extend outwardly of the perimeter 53 of the major surface face when the body is viewed facing normal to the minor surface face.

The edge surfaces are not completely planer from the perimeter 53 of the major surface face 35 to the perimeter 28 of the minor surface face 10. In particular, the edge surfaces 58 are stair-stepped between the major and minor surface faces 35, 10, comprising plural planar surfaces that intersect at an angle other than 180°. The overall shape of the tile is that of a "step pyramid." In a step pyramid shape, the entirety of an edge surface does not lie in a single plane. Instead, at least one edge surface comprises a step that extends in parallel to a side edge portion 56 of a surface face.

The edge surfaces 58 have different portions or band surfaces 61, 62, 63, that have generally uniform widths 50, 25, 85 around the entire perimeter of the tile as shown in FIGS. 1 and 3*a*-3*e*. These include major and minor corner band surfaces 61, 62 extending from the perimeters of the major and minor surface faces 35, 10 respectively. Each corner band surface 61, 62 extends at an angle from its corresponding surface face 35, 10 such that the corner band surface and the surface face meet at a corner 71, 72. In the advantageous system of FIGS. 1 and 3*a*-3*e*, both the corner band surfaces 61, 62 extend generally perpendicularly to the surface faces 35, 10. For each edge surface, the major corner band surface 61 extends generally in parallel to the minor corner band surface 62. Corner band surfaces are sometimes referred to herein as first and second surface portions.

For ease of reference, the tile can be considered to have a laterally extending ledge 60 that is defined by the band surface 63, the major corner band surface 61, and a portion of the major surface face 35. In general, the laterally extending portion(s) of an edge surface of a tile are sometimes referred to herein as a "ledge surface." Accordingly, in the tile of FIGS. 1 and 3*a*-3*e*, the band surface 63 is the ledge surface. The bridging band surface 63 is generally planar and extends diagonally, at an angle other than 90° to the surface faces, between the first and second corner band surfaces 61, 62. One of the corner band surfaces 62 is substantially planar and extends at an angle of 90° to the adjacent surface face 10. The other corner band surface 61 is substantially planar and extends at an angle of 90° to the face. The bridging band 63 does not extend substantially parallel to the surface faces 10, 35.

Figures 3A, 3B, 3C:
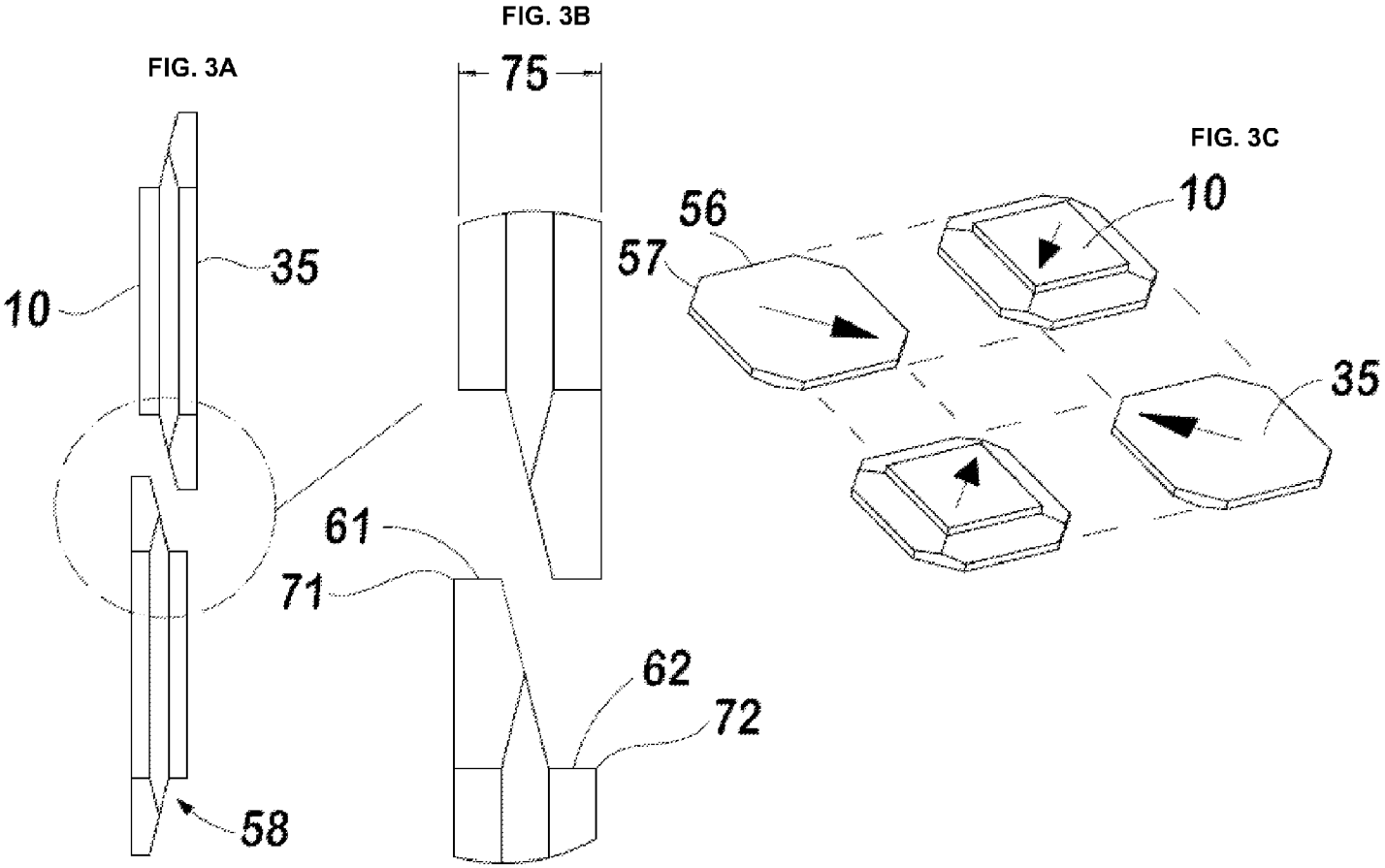
FIG. 3*a* is a side elevational view of an array of two of the tiles of FIG. 1*a*, with the tiles shown as being in reversed orientation relative to each other and aligned edge-to-edge.
FIG. 3*c* is an oblique view of an array of four of the tiles of FIG. 1*a* aligned edge-to-edge with immediately abutting tiles having their respective major and minor surface faces facing in opposite directions.
Figure 3E:
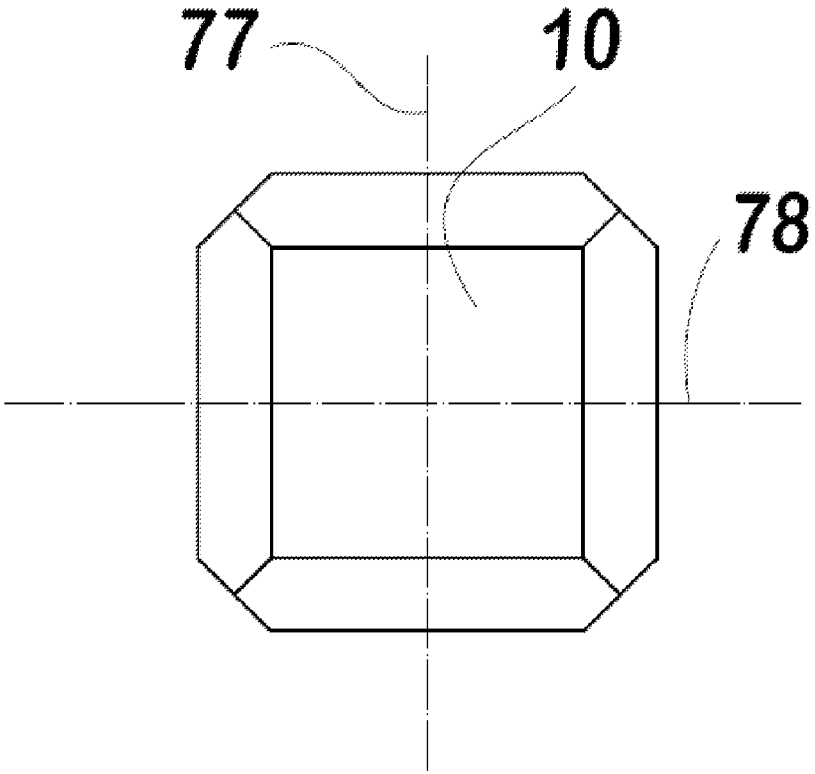
FIG. 3*e* is a front elevational view of the tile of FIG. 1*a*.
Figure 3D:
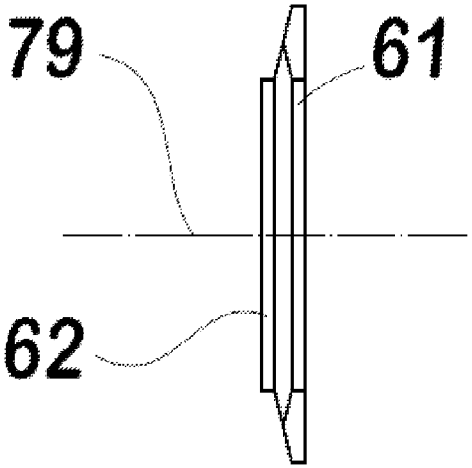
FIG. 3*d* is a side elevational view of the tile of FIG. 1*a*.

The major and minor surface faces are centered relative to each other such that the perimeter 28 of the minor surface face is generally everywhere equidistant from the perimeter 53 of the major surface face, as measured along lines perpendicular to corner band surfaces 61, 62, when the body is viewed facing the minor surface face, as in FIG. 3*e*, that is, $D_1$ and $D_2$ are equal distances on all four sides of the tile.

The tile is substantially bilaterally symmetrical about three mirror lines including two mirror lines 77, 78 that extend generally in parallel to and midway between each pair of opposed perimeter edges of the major and minor surface faces and one mirror line 79 that extends generally normal to the major and minor surface faces at their centers.

The tile of FIGS. 1 and 3*a*-3*e* is particularly advantageous because its edge surface is profiled such that the edge surfaces of any two abutting tiles conform to one another when the two identical tiles are positioned edge-to-edge with the surface faces of the two tiles facing in opposite directions, such that the major surface face of one tile faces in the same direction as the minor surface face of the abutting tile as illustrated in FIG. 3*a*-3*c*. Arrays made entirely from identical tiles that have such conforming edges are referred to herein as symmetric joint arrays.

Mating edge surfaces 58 do not have interlocking edge surfaces in the sense that abutting tiles can be tilted to some degree relative to one another in the manner of a hinge, if the tiles are suspended in the array in a manner that allows some movement.

FIGS. 3*a*-3*c* illustrate how several of such tiles can be assembled into an array with tiles positioned edge-to-edge with the surface faces of abutting tiles facing in opposite directions. In particular, the arrows appearing in FIG. 3*c* show how four tiles may be moved into position to assemble an array.

Figure 1B:
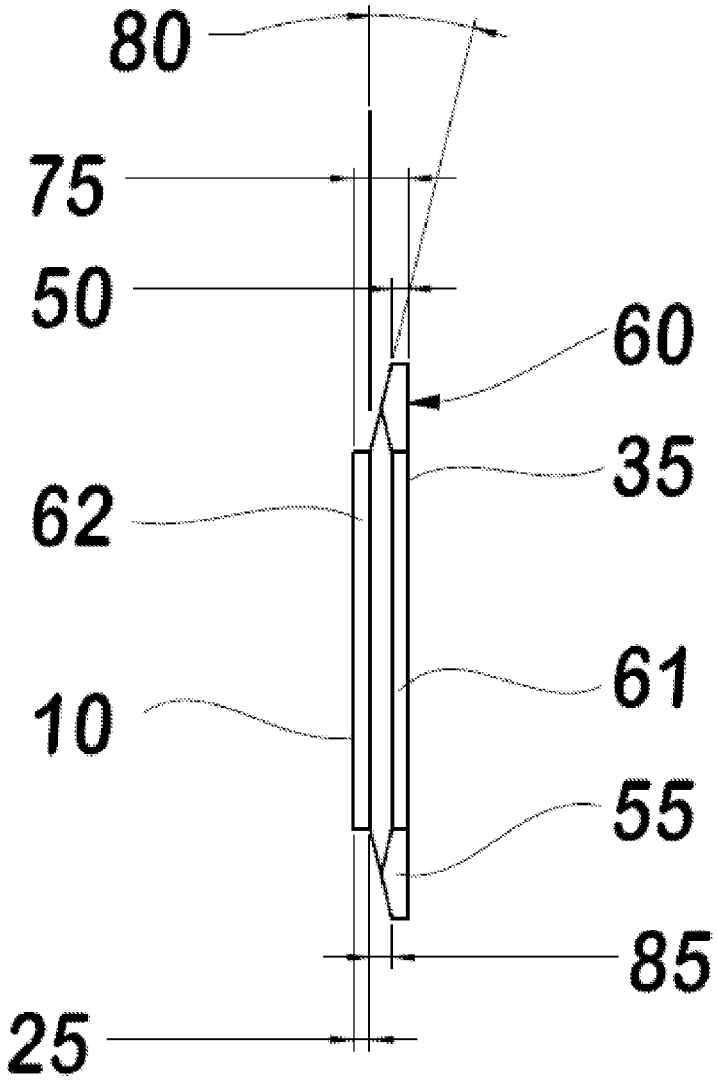
FIG. 1*b* is a side elevational view of the tile shown in FIG. 1*a*.
Figure 2A:
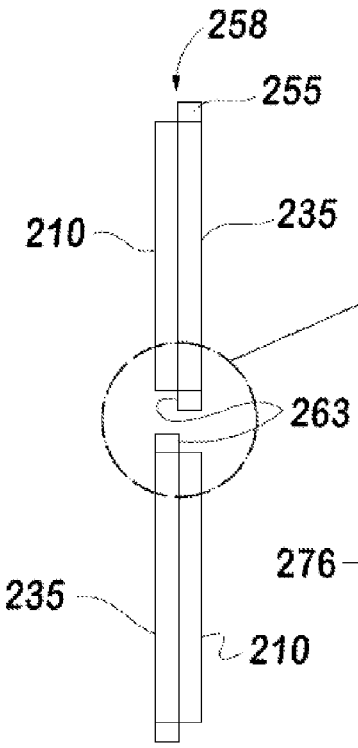
FIG. 2*a* is a side elevational view of an array of two identical tiles, with the tiles shown aligned edge-to-edge with their respective major and minor surface faces facing in opposite directions.
Figure 2B:
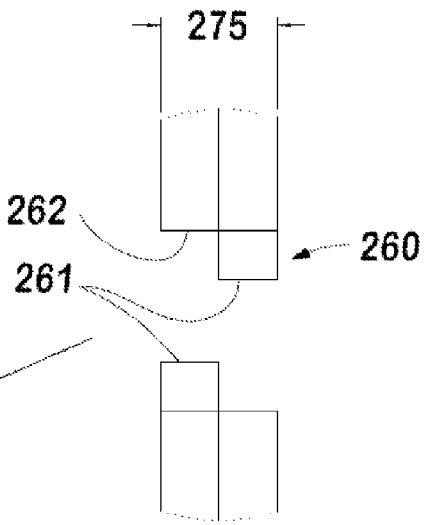
FIG. 2*b* is an enlarged partial side elevational view of facing edge portions of the tiles shown in FIG. 2*a*.
Figure 2C:
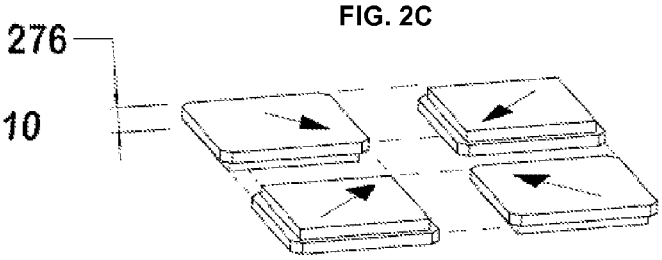
FIG. 2*c* is an oblique view of an array of four of the tiles of FIG. 2*a* aligned edge-to-edge with immediately abutting tiles having their respective major and minor surface faces facing in opposite directions.

FIGS. 2*a*-2*c* show a different tile and illustrate that the angles between adjacent edge surfaces can differ. (The element numbers of similar elements in FIGS. 2*a*-2*c* are the same as in FIGS. 1 and 3*a*-3*e*, but with the numbers incremented by 200.) In this tile, the ledge surface is a bridging band surface 263 that extends substantially parallel to the surface faces between the first and second corner band surfaces 261, 262. One of the corner band surfaces 262 is substantially planar and extends at an angle of 90° to the adjacent surface face 210. The other corner band surface 261 is substantially planar and extends at an angle of 90° to the face 210. The bridging band surface 263 is substantially planar. The tile has a laterally extending ledge 260 that is defined by the bridging band surface 263, the major corner band surface 261, and a portion of the major surface face 235. FIGS. 2*a*-2*c* illustrate how several of such tiles can be assembled into an array with tiles positioned edge-to-edge with the surface faces of abutting tiles facing in opposite directions. In particular, the arrows appearing in FIG. 2*c* show how four tiles may be moved into position to assemble an array.

FIGS. 4*a*-4*c* show tiles 411*a*, 411*b* that are not identical to one another but that have mating edge surfaces. (The element numbers of similar elements in FIGS. 4*a*-4*c* are the same as in FIGS. 1 and 3*a*-3*e*, but with the numbers incremented by 400.) The major corner band surface 461*a* of tile 411*a* extends generally perpendicularly to the major surface face 435*a*. The minor corner band surface 462*a* of tile 411*a* flares from the minor surface face 410*a* as shown in FIGS. 4*a*-4*b*. The major corner band surface 461*b* of tile 411*b* tapers from the major surface face 435*b* as shown in FIGS. 4*a*-4*b*. The minor corner band surface 462*b* of tile 411*b* extends generally perpendicularly to the minor surface face 410*b*. In these tiles, the ledge surfaces are bridging band surfaces 463*a*, 463*b* that extend substantially parallel to the surface faces respectively between the first and second corner band surfaces 461*a*, 462*a* and 461*b*, 462*b*. The tile 411*a* has a laterally extending ledge 460*a* that is defined by the bridging band surface 463*a*, the major corner band surface 461*a*, and a portion of the major surface face 435*a*. And the tile 411*b* has a laterally extending ledge 460*b* that is defined by the bridging band surface 463*b*, the major corner band surface 461*b*, and a portion of the major surface face 435*b*. FIG. 4*a*-4*c* illustrate how several of such tiles can be assembled into an array with tiles positioned edge-to-edge with the surface faces of abutting tiles facing in opposite directions. In particular, the arrows appearing in FIG. 4*c* show how four tiles may be moved into position to assemble an array.

Figures 5A, 5B, 5C:
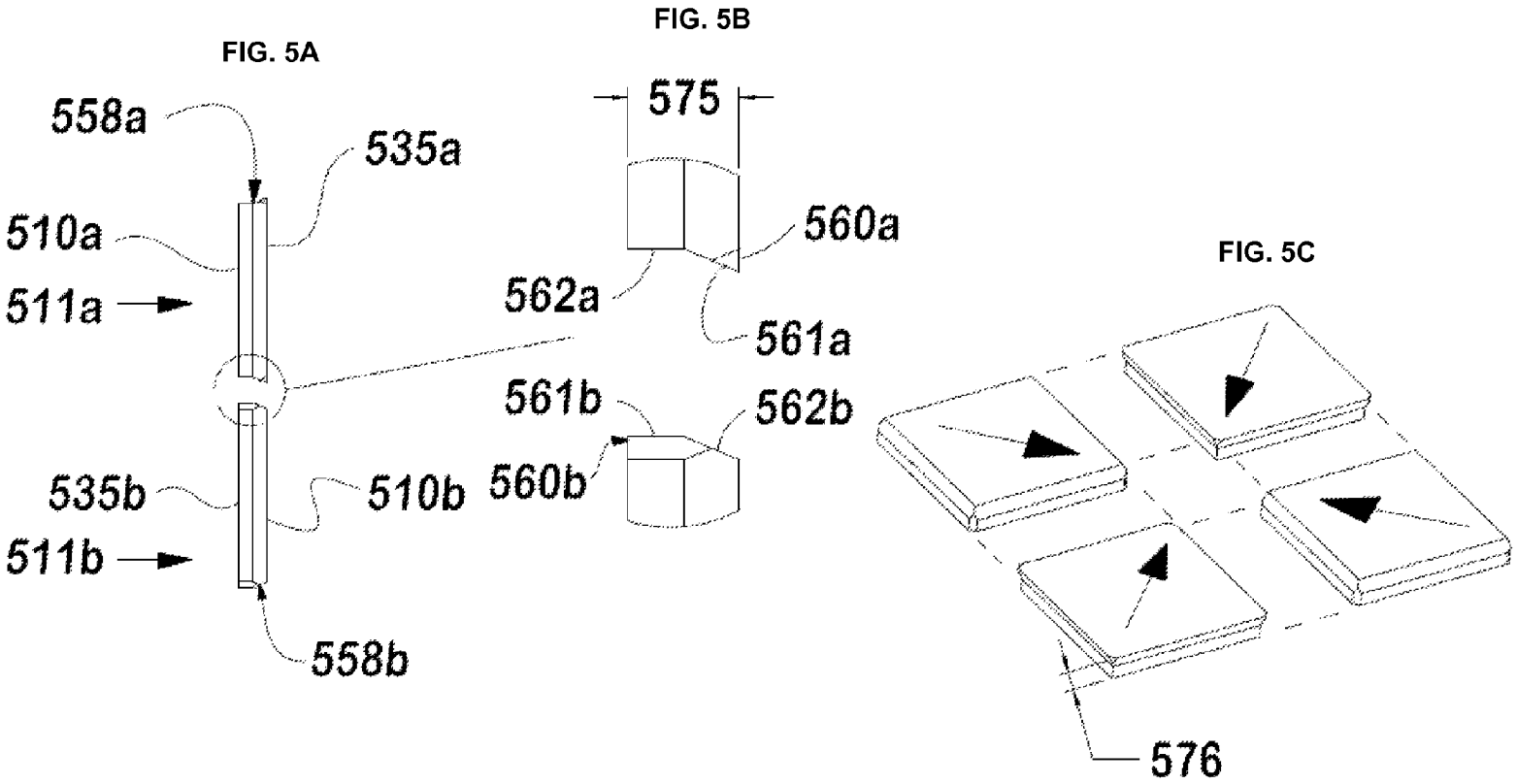
FIG. 5*a* is a side elevational view of an array of two non-identical tiles with the tiles shown aligned edge-to-edge with their respective major and minor surface faces facing in opposite directions.
FIG. 5*b* is an enlarged parital side elevational view of facing edge portions of the tiles shown in FIG. 5*a*.
FIG. 5*c* is an oblique view of an array of two of each of the tiles shown in FIG. 5*a* aligned edge-to-edge with the two types of tiles having their respective major and minor surface faces facing in opposite directions.
Figure 6C:
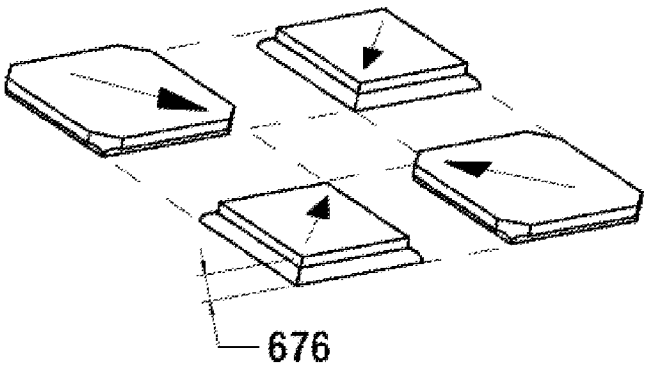
FIG. 6*c* is an oblique view of an array of two of each of the tiles shown in FIG. 6*a* aligned edge-to-edge with the two types of tiles having their respective major and minor surface faces facing in opposite directions.
Figure 6B:
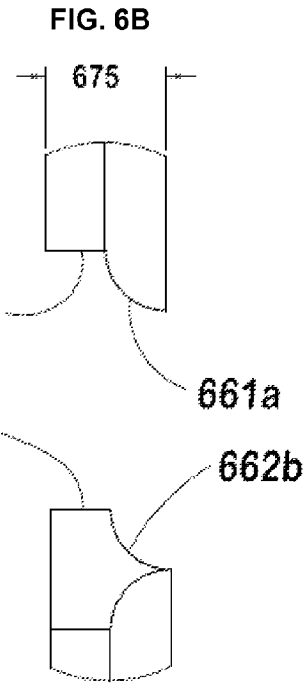
FIG. 6*b* is an enlarged parital elevational view of facing edge portions of the tiles shown in FIG. 6*a*.
Figure 6A:
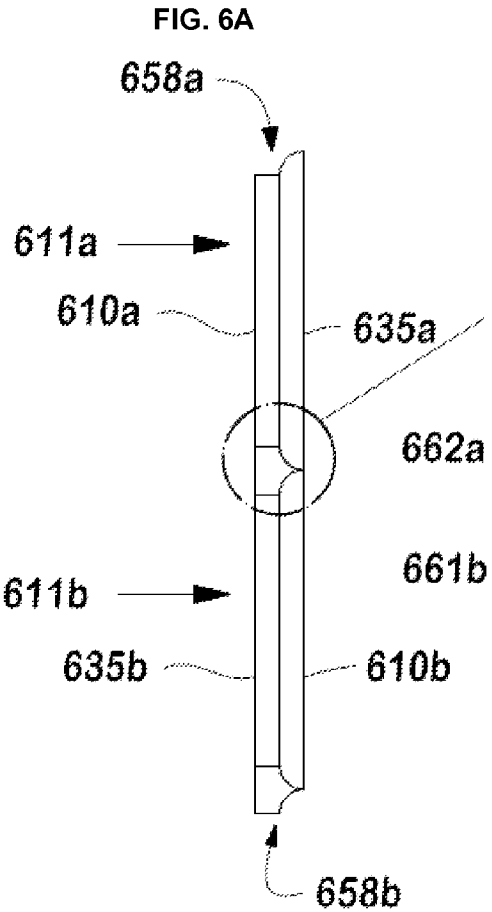
FIG. 6*a* is a side elevational view of an array of two non-identical tiles with the tiles shown aligned edge-to-edge with their respective major and minor surface faces facing in opposite directions.

FIGS. 5*a*-5*c* show tiles 511*a*, 511*b* that are not identical to one another but that have mating edge surfaces. (The element numbers of similar elements in FIGS. 5*a*-5*c* are the same as in FIGS. 1 and 3*a*-3*e*, but with the numbers incremented by 500.) Tiles 511*a*, 511*b* have no bridging band surfaces, only major corner band surfaces 561*a*, 561*b* and minor corner band surfaces 562*a*, 562*b* respectively. The major corner band surface 561*a* of tile 511*a* tapers from the major surface face 535*a* as shown in FIGS. 5*a*-5*b*. The minor corner band surface 562*a* of tile 511*a* extends generally perpendicularly to the minor surface face 510*a*. The major corner band surface 561*b* of tile 511*b* extends generally perpendicularly to the major surface face 535*b*. And the minor corner band surface 562*b* of tile 511*b* flares from the minor surface face 510*b* as shown in FIGS. 5*a*-5*b*. The tile 511*a* has a laterally extending ledge 560*a* that is defined the major corner band surface 561*a* and a portion of the major surface face 535*a*. And the tile 511*b* has a laterally extending ledge 560*b* that is defined by the minor corner band surface 562*b*, the major corner band surface 561*b*, and a portion of the major surface face 535*b*. In these tiles, the ledge surfaces thus are the surfaces 561*a*, 562*b*. FIGS. 6*a*-6*c* illustrate how several of such tiles can be assembled into an array with tiles positioned edge-to-edge with the surface faces of abutting tiles facing in opposite directions. In particular, the arrows appearing in FIG. 6*c* show how four tiles may be moved into position to assemble an array.

FIGS. 6*a*-6*c* show tiles 611*a*, 611*b* that are not identical to one another but that have mating edge surfaces. (The element numbers of similar elements in FIGS. 6*a*-6*c* are the same as in FIGS. 1 and 3*a*-3*e*, but with the numbers incremented by 600.) Tiles 611*a*, 611*b* have no bridging band surfaces, only major corner band surfaces 661*a*, 661*b* and minor corner band surfaces 662*a*, 662*b* respectively. Notably, in these tiles, the band surfaces 661*a*, 662*b* have a curved profile, as shown best at FIG. 6*b*. In particular, the band surfaces 661*a*, 662*b* have a cross section that is a portion of a circle so that the band surfaces 661*a*, 662*b* are portions of cylindars. (A portion of each band surface 661*a*, 662*b* could be considered to be a "bridging band surface." In particular, portions nearest the band surfaces 661*b*, 662*a* might be considered to be "bridging band surfaces" because the curved band surfaces 661*a*, 662*b* might be considered to comprise plural surfaces.) The major corner band surface 661*a* of tile 611*a* tapers from the major surface face 635*a* as shown in FIGS. 6*a*-6*b*. The minor corner band surface 662*a* of tile 611*a* extends generally perpendicularly to the minor surface face 610*a*. The major corner band surface 661*b* of tile 611*b* extends generally perpendicularly to the major surface face 635*b*. And the minor corner band surface 662*b* of tile 611*b* flares from the minor surface face 610*b* as shown in FIGS. 6*a*-6*b*. The tile 611*a* has a laterally extending ledge 660*a* that is defined the major corner band surface 661*a* and a portion of the major surface face 635*a*. And the tile 611*b* has a laterally extending ledge 660*b* that is defined by the minor corner band surface 662*b*, the major corner band surface 661*b*, and a portion of the major surface face 635*b*. In these tiles, the ledge surfaces thus are the surfaces 661*a*, 662*b*.

General Considerations

As discussed above, the major surface faces of the various tiles have perimeters that are octagons. This is because tiles having rectangular major surface face perimeters experience corner interference. Corner interference prevents tiles from fitting closely together with tight seams. The corners of the tile ledges thus are chamfered to avoid interference. Each tile shape has corner interference conditions which dictate the extent of truncation required. The corners of the minor surface face need not be chamfered in order to avoid corner interference.

In the illustrated tiles, for example the tile shown in FIG. 1*a*, to avoid corner interference, each side edge portion 56 of the perimeter of the major surface face 35 is the same length as and extends in parallel to the nearest edge portion of the perimeter edge 28 of the minor surface face 10. Also, the ends of each side edge portion 56, which are located at the corners 59 of the perimeter of the major surface face 35, are aligned respectively with edge portion ends, which are located at the corners 59 of the perimeter of the minor surface face 10, along a line that are collinear with an edge portion of the perimeter of the minor surface as viewed facing normal to the minor surface face. As mentioned above, the major surface face 35 is defined by an octagonal edge 53 at the perimeter of the major surface face. The edge 53 consists of eight edge portions extending between the corners 59 of the octagonal edge. The two edge portions at each corner 59 extend at an internal angle of about 135° relative to each other. The minor surface face 10 is defined by a rectangular edge 28 that consists of four edge portions. And the distance from the minor surface face perimeter to the major surface face perimeter is uniform around the perimeter of the minor surface face 10 where the distance $D_1$, $D_2$ is measured along lines, such as lines 65, 70, extending perpendicular to the side edge portions 56 of the major surface face 35 as viewed facing normal to the minor surface face.

It should be appreciated that angles, distances, and geometric relationships mentioned herein can vary to some extent without significantly affecting the performance of a tile array. The amount of allowable variation will depend on the needs and requirements of the application and on the thickness and other dimensions of the tiles and may be determined empirically or by mathematical calculation. As an example, the corner angles of the tile shown in FIGS. 1*a*, 1*b*, and 3*a*-3*e* can vary slightly. The extent of the allowable variation will depend on the width $D_1$, $D_2$ of the ledge or, in other words, will depend on the ratios of the dimensions 15, 40, and 20, 45 of the major and minor surface faces. Although it is ideal for adjacent edges of the major surface perimeter meet at an internal angle of 135°, good results can be achieved with corners 59 having internal angles of 135° plus or minus 4°. And for some configurations, the internal angles could be 135° plus or minus 10° without creating a 90° straight-through gap. And as a general matter, it typically is not practical to mass produce tiles of the type described herein to have perfect dimensions. Such variations are applicable to all the tiles described herein.

In an array, tiles are positioned edge-to-edge and meet at joints. The tiles have mating edges of one of two types, "symmetric" and "asymmetric." Tiles having symmetric edges are shown in FIGS. 1, 2*a*-2*c*, and 3*a*-3*e*. Such tiles can be "turned over" and fit to abutting tiles. The edges have a profile such that, when two such tiles are inverted relative to each other and placed edge-to-edge, the facing edges are complimentary and mate as shown in FIG. 3*c* such that an array can be built using only tiles of this configuration. Advantageously, in symmetric edge tiles the minor surface depth 25 and the major surface depth 50 will be substantially equal as shown in FIGS. 1 and 3*a*-3*e*. At least a portion of the major corner band surface can be the same depth 50 as the depth 25 of at least a portion of the minor corner band surface, with the depths being measured normal to the major surface face. The entire major corner band surface can be the same death 50 as the depth 25 of the entire minor corner band surface, with the depths being measured normal to the major surface face as shown in FIGS. 2*a*-2*c*. All aspects of the manufacture and use of tiles described herein are simplified by the use of symmetric types.

Asymmetric edge tiles do not conveniently invert and require at least two types of tiles used in pairs to fit together to form an edge-to-edge array of tiles. But asymmetric type tiles can have edge profiles that are advantageous for forming tile arrays to be used for certain applications. Tiles having asymmetric edges are shown in FIGS. 4*a*-4*c*, 5*a*-5*c*, and 6*a*-6*c*.

In the symmetric-edged tile of FIGS. 1 and 3*a*-3*e*, the major-to-minor surface connecting ledge surface 63 is at an angle other than 90° to the horizontal axis 70 extending from the bottom of the minor surface depth 25 to the top edge of the major surface such that the minor surface depth 25 and the major surface depth 50 are approximately equal.

As shown in FIG. 1*a* and FIG. 1*b*, the ledge surface angle 80 is such that the minor surface depth 25 and the major surface depth 50 are substantially equal. The angle can be calculated with normal mathematical equations. The angle will depend on the minor surface depth 25, the major surface depth 50, the total thickness of the tile 75, and the relative sizes of the minor surface face 10 and major surface face 35, which determine the distances $D_1$ and $D_2$.

As previously observed, the tiles of FIGS. 1 and 3*a*-3*e* and the tiles of FIGS. 2*a*-2*c* have and major and minor surface faces with perimeters that respectively are octagonal and square. Tiles having minor surface face perimeters that are "rectangles" other than squares can have similar symmetric-edge profiles.

The symmetric-edge tile shown in FIGS. 2*a* and 2*b* is configured such that a single tile can be inverted to form an array in all directions which has no 90° through joints. There are no straight-through gaps between abutting tiles. The chamfers 255 extending from the major surface face allow the ledges 260 of abutting tiles to overlap and thus not increase the thickness of the entire array beyond the total thickness of an individual tile. The minor surface depth 225 and the major surface depth 250 are equal in order to have the surfaces of abutting inverted tiles align. The depth could be somewhat unequal, if surface mismatch is not an important issue. The minor to major surface connecting ledge surface 263 is at 90° to the vertical center line extending from the bottom of the minor surface depth 225 to the top edge of the major surface 250 parallel to the minor and major surfaces, in the horizontal axis.

Tile arrays having asymmetric joints can be seen as being formed from alternating "A" and "B" configuration tiles. The use of A and B tiles is best in certain applications, for example to allow different thicknesses and connecting ledges to be used for the minor surface depth and perimeter and the major service depth and perimeter. Asymmetric tiles employ the same type of corner chamfer as the symmetric configuration tiles allowing ledges to overlap with tiles aligned in a common plane. Any of several angles and/or radii can be used for the edge band surfaces of asymmetric tiles so long as the edge profiles are matched so that the facing edges of abutting A and B tiles mate.

Curved arrays can be formed from the tiles described herein and are particularly useful for better fit in situations where the surface to be covered is not flat.

Such curved arrays can be formed from flat tiles by setting abutting tiles at an angle to one another to form an arcuate array. With such arrays, there will be small gaps between the tiles at a convex surface of the array. But such arrangements are workable for certain applications because even with a small gap at the convex surface, the array will not have a 90° gap through to the opposite concave surface.

Figure 7:
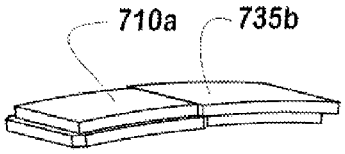
FIG. 7 is an oblique view of an array of two non-identical tiles having curved faces, with the tiles aligned edge-to-edge with the two types of tiles having their respective major and minor surface faces facing in opposite directions.

The gap at the convex surface of adjacent tiles can be substantially reduced and for certain large radii be effectively eliminated by the use of tiles having curved surface faces, with one of the surface faces being at least partially concave and the other of the surface faxes being at least partially convex. FIG. 7 shows example tiles having curved surface faces 710*a*, 735*b*, in particular, surface faces that are portions of cylinders that are concentric. For most applications in which curvature is helpful, both the major surface face and minor surface face of the tiles is a curved surface having a radius of at least 4 inches.

The radii that can be used to form the desired curvature can easily be calculated by well understood geometric engineering principles. The size of the tile can be varied to meet desired curvature and acceptable surface gaps. The variations are many. By way of illustration, but without limiting the size of tile or radius:

a. A tangent circle radius of 10 inches using a curved tile 2 inches square will result in a convex surface gap of 0.0151 inches and the same curvature made with angled flat tiles of the same size will result in a convex surface gap of 0.0564 inches, or 3.75 times greater.

b. If the size of the tile is reduce to 1 inch, the convex surface gap for a 10 inch tangent circle radius will be approximately 50% smaller or 0.0075 inches.

c. If the size of the tile is made 4 inches, the convex surface gap is increased by about 2 times to about 0.0304 inches.

d. A tangent circle radius of 60 inches made with 2 inch curved tiles will result in a convex surface gap of 0.0025, as a practical matter very small.

e. In all cases, because of the overlap edges of adjacent tiles the convex surface gap is only on the surface, decreases as it moves to the center of the tile, and in no case is a 90° through gap to the minor surface created.

The tiles shown in FIG. 7 have major surface faces and minor surface faces that generally are portions of cylinders and that are concentric. The tile has a total thickness that is generally uniform as measured anywhere along radii of the cylindrical surfaces. Curved-surface tiles having surfaces that are portions of cylinders are the most practical to manufacture in quantity. But tile surfaces could be portions of spheres or could have even more complex curvatures.

Figure 8:
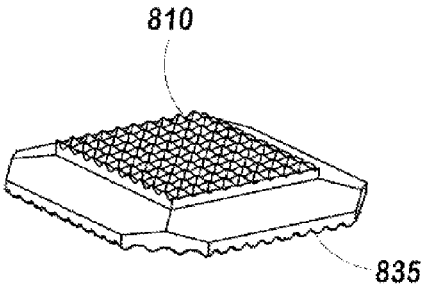
FIG. 8 is an oblique view of a tile having textured major and minor surface faces.

Any of the tiles described herein may have a textured surface face. For example, the tile shown in FIG. 8 has both the minor and major surface faces 810, 835 that are textured. The textured surface can have ridges and/or peaks formed by the appropriate placement of triangles (pyramids), squares (cubes), rectangles, and/or curved radii ridges (waves) where the depth of any depression is not more than 60% of the distance between peaks or ridges.

Figure 9:
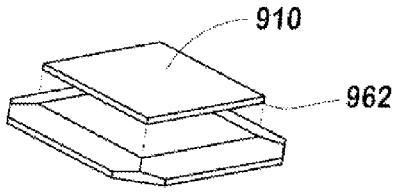
FIG. 9 is an oblique exploded view of a tile having the shape shown in FIG. 1 with the tile being constructed from two separate pieces.

Tiles of a unitary construction, where the entire tile is a formed as a single piece having a uniform composition throughout, is the most efficient for most applications. However, any of the tiles described herein can be made in more than one part, which can be advantageous in some applications. For example, FIG. 9 shows a tile of the shape shown in FIGS. 1, 2*a*-2*c*, and 3*a*-3*e*. Only the tile of FIG. 9 differs in that it is a sandwich arrangement where parallelepiped portion defined by the minor surface face 910 and the minor corner band surface 962 is formed separately from the remainder of the tile. The tile portions can be bonded together by any of several conventional methods including but not limited to adhesives, brazing, tape, welding, and glue with or without heat. Separate tile portions also may be held in place, without bonding, by envelopment within a matrix material, such as by wrapping with fabric, positioning in pockets formed in fabric, or the like.

The tiles described herein are configured to allow construction from very hard materials such as the various ceramics currently used in the manufacture of tiles. Ceramic tiles, particularly those used for ballistics applications, will have a hardness of at least 1000 Vickers.

Tiles of hard materials are best are formed by processes using mechanical or hydraulic presses and using dies with outer configurations and/or top and or bottom punches and/or cavities that will produce a green body for an entire tile of a desired shape. The green body is cured by heat or some other method to complete formation of the tile.

The edge design may be applied without regard to the size, large or small, with the limitation being dependant on the capacity of the equipment used to make or form the tile.

Frusto-pyramidal tiles, as described herein, are particularly well suited for efficient, high rate production by such standard pressing processes because there are no undercuts in the edge surfaces. Such tiles most efficiently can be of unitary construction, which is to say not constructed from plural laminated parts.

To form such tiles efficiently, the edge surfaces must not grooved or otherwise undercut. This permits efficient production by the use of rapid-rate closed-die manufacturing methods.

For example, to form armor tiles having appropriate properties, a powder is pressed into a die to form a green compact. The green compact is ejected from the die and then heated to sinter the powder to complete the tile. Rapid and repeated reuse of dies is essential to success.

The use of dies can be made highly efficient by forming tiles in the presently claimed configurations, where the edges of the tiles are without undercuts. A tile having an undercut cannot be formed in a simple uniaxial die.

The issue of undercuts is discussed in *Powder Metallurgy Science*, second edition, Randall M. German, 1994, ISBN 1-878954-42-3, page 234. That publication states that to achieve compact integrity and dimensional control, the tooling should be kept as simple as possible along the axis of pressing. The shape must allow for easy powder flow into the die cavity and easy ejection. Thus, certain shapes are not possible for uniaxial pressing and require methods such as isostatic pressing or dies which can be disassembled on each pressing cycle.

A tile with an undercut portion is an example of such a shape that is not possible for uniaxial pressing.

A uniaxial die has a straight-sided wall and upper and lower punches that conform to the shape of the die wall. One or both punches travel along an axis to compact a loaded compactible material charge. This is the most efficient tool for mass production of hard parts such as armor tiles.

For example, U.S. Pat. No. 6,318,986, titled Undercut Split Die, col. 1, lines 17-19, states: "In some cases, the compacted part has an undercut which prevents removal of the part or blank from the dies by linear or axial displacement."

As noted in German, "certain shapes are not possible for uniaxial pressing and require methods such as cold isostatic pressing or dies which can be disassembled on each pressing cycle." Such "not possible" shapes include parts with undercuts. And, although parts with undercuts can be formed using "isostatic pressing or dies which can be disassembled on each pressing cycle," such elaborate processes are not efficient for making tiles in high volume.

The inefficiency of dies which must be disassembled is shown by publications such as U.S. Pat. Nos. 5,102,607; 5,503,795; 5,698,149; 5,772,748; and 6,318,986. These patents show and describe just how elaborate dies must be to deal with the problem of undercuts.

Isostatic pressing can be used to form green bodies to be used for making hard parts having undercut portions by powder metallurgy, but isostatic pressing is highly inefficient such that hard tiles having undercut portions still cannot be made economically.

Tiles of the shapes described herein, without undercuts, can be made without the need for such costly, wear-prone, and relatively slow-cycling dies or isostatic pressing. For example, a tile of the type shown in FIGS. 1 and 3*a*-3*e* can be formed in a uniaxial die having a central pressing axis that extends normal to the minor and major surface faces 10, 35, coincident with the line 79 shown in FIG. 3*d*, because the edges of such a tile have no recess, groove, channel, or wall surface that extends radially inwardly toward the central pressing axis so as to prevent linear displacement of the part from the die by only simple axial movement of the punches.

Figure 10:
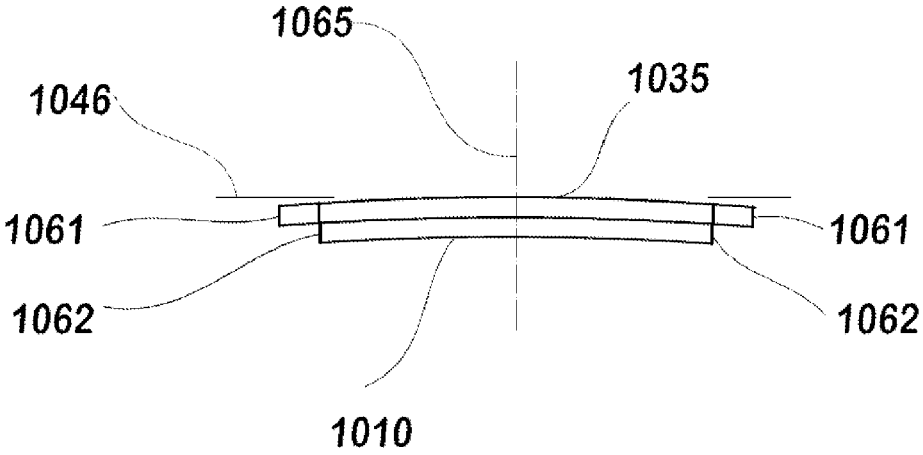
FIG. 10 is a side elevational view of a tile having curved faces.

Curved tiles of the type shown in FIG. 7 also can be formed using uniaxial dies, which permits efficient high volume production. Here again there must be no undercut edges so that the tiles can be pressed and ejected from a simple die. This can be accomplished efficiently by making tiles having edge surface portions that do not extend radially but that, for example, instead extend parallel to the axis of the die used during the forming process. FIG. 10, for example, shows a tile having edge surface portions 1061, 1062 that extend in parallel to a centerline 1065, which in turn extends in parallel to the pressing axis of a die best suited for forming such a tile. For the tile of FIG. 10, the pressing axis of the die thus is normal to a line 1046 that is tangential to the center of major surface face 1035.

In some instances, in addition to the tiles described herein, an array could include some tiles having undercuts. Although it is not practical to make numerous hard tiles having undercuts, non-uniaxial dies or isostatic pressing could be used to make some such tiles in low volume for use in limited areas to make an overall array more effective. Such tile shapes also could be formed from a meltable material by die casting. Or a body of a ceramic material could be machined to form a tile having such a shape.

In the illustrated tiles, the major and minor surface faces generally are everywhere equidistant. Although the major and minor surface faces best are substantially continuous, one or both of the surface faces may define a cavity for the purpose of weight reduction or may have a surface texture shaped to deflect an incident projectile. And for some applications, it is not necessary for the face surfaces of abutting tiles in an array to be aligned precisely; but an array could instead have a surface with a cross-sectional profile in the nature of a square wave with the surface faces of abutting tiles at somewhat different elevations.

In view of the many possible embodiments to which the principles of the disclosed invention may be applied, it should be recognized that the illustrated tiles are only examples and should not be taken as limiting the scope of the invention.

The invention claimed is:

1. A tile having:

a major surface face bounded by an octagonal edge at the perimeter of the major surface face, the edge consisting of four side edge portions and four chamfer edge portions, the side and chamfer edge portions alternating progressively around the perimeter with each pair of adjacent side and chamfer edge portions extending from a corner at an internal angle of 135° relative to each other;

a minor surface face that is bounded by a rectangular edge at the perimeter of the minor surface face, the edge consisting of four edge portions that respectively extend in parallel to the four side edge portions of the major surface face when the tile is viewed facing normal to the minor surface face with each pair of adjacent edge portions extending from a corner at an internal angle of 90° relative to each other and, the minor surface face having a smaller area than the major surface face, the minor surface face being positioned such that the perimeter of the minor surface face does not extend outwardly of the perimeter of the major surface face when the tile is viewed facing normal to the minor surface face, and the distance from the minor surface face perimeter to the major surface face perimeter being uniform around the perimeter of the minor surface face where the distance is measured along lines extending perpendicular to the side edge portions of the major surface face as viewed facing normal to the minor surface face, each side edge portion of the perimeter of the major surface face is the same length as and extends in parallel to the nearest edge portion of the perimeter of the minor surface face, and each corner of the perimeter of the major surface face is aligned with two corners of the perimeter of the minor surface face along a line that coincides with an edge portion of the perimeter of the minor surface face, as viewed facing normal to the minor surface face; and edge surfaces extending between the perimeters of the major and minor surface faces, without any undercut portion relative to an axis that extends normal to at least one of the major and minor face surfaces, at least one of the edge surfaces and a portion of the major surface face defining a laterally extending ledge that is shaped so that plural tiles can fit together edge-to-edge with a ledge of the one tile overlying a ledge of the abutting tile with only a portion of the thickness of each tile overlapping, and the edge surfaces being shaped such that the edge surface of the one tile generally conforms to the edge surface of the other tile when the pair of tiles is positioned edge-to-edge with their respective major and minor surface faces facing in opposite directions.

2. A tile of claim 1 wherein the ledge is shaped so that plural tiles can fit together edge-to-edge with the major and minor surface faces of one tile generally aligned respectively with the minor and major surface faces of an abutting tile.

3. A tile of claim 1 wherein the edge surfaces are not continuous planes extending from the perimeter of the major surface face to the perimeter of the minor surface face.

4. A tile of claim 1 wherein the minor surface face is generally everywhere equidistant from the major surface face as measured anywhere between the minor surface face and major surface along a line that extends normal to the surfaces.

5. A tile of claim 1 wherein the tile is dimensioned such that the face-to-face thickness of a pair of tiles positioned edge-to-edge is no greater than the distance between the major and minor surface faces of one of the tiles.

6. A tile of claim 1 wherein:

each edge surface comprises a major corner band surface extending from the perimeter of the major surface face and a minor corner band surface extending from the perimeter of the minor surface face; and a laterally extending ledge is defined by the major corner band surface and a portion of the major surface face.

7. A tile of claim 1 wherein:

each edge surface comprises a major corner band surface extending from the perimeter of the major surface face, a minor corner band surface extending from the perimeter of the minor surface face, and one or more bridging band surfaces that extend between the major and minor corner band surfaces; and a laterally extending ledge is defined by the major corner band surface, a portion of the major surface face, and the one or more bridging band surfaces.

8. A tile of claim 1 wherein at least a portion of at least one edge surface comprises a step that extends in parallel to a side edge portion.

9. A tile of claim 1 wherein the step comprises a major corner band surface extending from the perimeter of the major surface face and a minor corner band surface extending from the perimeter of the minor surface face.

10. A tile of claim 1 wherein:

one of the corner band surfaces is substantially planar and extends at an angle of 90° to the adjacent surface face; and the other corner band surface is substantially planar and extends at an angle other than 90° to the adjacent surface face.

11. A tile of claim 1 wherein:

one of the corner band surfaces is substantially planar and extends at an angle of 90° to the adjacent surface face; and the other corner band surface has a cross section that is curved.

12. A tile of claim 1 wherein:

one of the corner band surfaces is substantially planar and extends at an angle of 90° to the adjacent surface face;

the other corner band surface is substantially planar and extends at an angle of 90° to the face; and the tile further comprises a bridging band surface that is substantially planar, that extends between the corner bands, and that extends in parallel to the surface faces.

13. A tile of claim 1 wherein:

one of the corner band surfaces is substantially planar and extends at an angle of 90° to the adjacent surface face;

the other corner band surface is substantially planar and extends at an angle of 90° to the face; and the tile further comprises a bridging band surface that is substantially planar, that extends between the corner bands, and that does not extend substantially parallel to the surface faces.

14. A tile of claim 1 wherein each edge surface comprises a single bridging band surface that extends generally in parallel to the faces between the major and minor corner band surfaces.

15. A tile of claim 1 wherein each edge surface comprises a single bridging band surface that extends at an angle other than 90° to the faces between the major and minor corner band surfaces.

16. A tile of claim 1 further comprising at least one cavity defined in at least one of the surface faces or at least one raised area that extends from least one of the surface faces.

17. A tile of claim 1 wherein:

the four side edge portions are of equal length;

the four chamfer edge portions are of equal length; and the tile has an edge profile such that the edges of two identical ones of the tile mate with one another.

18. A tile of claim 1 wherein:

all the side edge portions of the perimeter of the major surface face and all the edge portions of the perimeter of the minor surface face are the same length;

the perimeter of the minor surface face is square and each of the edge portions of the perimeter of the minor surface face extends in parallel to the closest side edge portion of the major surface face; and the minor surface face is centered within the perimeter of the major surface face when the body is viewed facing normal to the minor surface face.

19. A tile of claim 1 wherein the tile is substantially bilaterally symmetrical about three mirror lines including two minor lines that extend generally in parallel to and midway between each pair of opposed perimeter edges of the major and minor surface faces and one mirror line that extends generally normal to the major and minor surface faces at their centers.

20. A tile of claim 1 wherein:

one of the band surfaces is a major corner band surface extending from the perimeter of the major surface face and another of the band surfaces is a minor corner band surface extending from the perimeter of the minor surface face with each corner band surface extending at an angle from its corresponding face; and at least a portion of the major corner band surface is the same depth as the depth of at least a portion of the minor corner band surface, with the depths being measured normal to the major surface face.

21. A tile of claim 1 wherein the entire major corner band surface is the same depth as the depth of the entire minor corner band surface, with the depths being measured normal to the major surface face.

22. A tile of claim 1 wherein:

the major corner band surfaces extend generally normal to the major surface face; and the minor corner band surfaces extend generally normal to the minor surface face.

23. A tile of claim 1 wherein, for each edge surface, the major corner band surface extends generally in parallel to the minor corner band surface.

24. A tile of claim 1 wherein each edge surface comprises a single bridging band surface that extends between the major and minor corner band surfaces, with the bridging band surface intersecting minor corner band surface at an obtuse angle.

25. A tile of claim 1 wherein the major surface face and minor surface face are curved surfaces.

26. A tile of claim 25 wherein one of the surface faces is at least partially concave and the other of the surface faxes is at least partially convex.

27. A tile of claim 25 wherein the major surface face and minor surface face are portions of cylinders that are concentric.

28. A tile of claim 25 wherein the major surface face and minor surface face each have a radius of at least 4 inches.

29. A tile of claim 1 that is of unitary composition.

30. A tile of claim 1 comprising plural tile portions that are secured together.

31. A tile of claim 30 wherein the plural tile portions are bonded together.

32. A tile of claim 30 further comprises a matrix material which holds the plural tile portions in place by envelopment.

33. A tile of claim 32 wherein the matrix material comprises fabric.

34. A tile of claim 1 consisting of a material having a hardness of at least 1000 Vickers.

35. A tile consisting of a material having a hardness of at least 1000 Vickers, the tile having:

a major surface face bounded by an edge at the perimeter of the major surface face;

a minor surface face that is bounded by an edge at the perimeter of the minor surface face, that is generally everywhere equidistant from the major surface face, that has a smaller area than the major surface face, and that is positioned such that the perimeter of the minor surface face does not extend outwardly of the perimeter of the major surface face when the tile is viewed facing normal to the minor surface face; and edge surfaces extending between the perimeters of the major and minor surface faces, at least one of the edge surfaces and a portion of the major surface face defining a laterally extending ledge;

the ledge being shaped so that plural tiles can fit together edge-to-edge with the major and minor surface faces of one tile generally aligned respectively with the minor and major surface faces of an abutting tile and with a ledge of the one tile overlying the ledge of the abutting tile, with only a portion of the thickness of each tile overlapping, the edge surfaces not being a continuous planes extending from the perimeter of the major surface face to the perimeter of the minor surface face, and the edge surfaces being shaped such that the edge surface of the one tile generally conforms to the edge surface of the other tile when the pair of tiles is positioned edge-to-edge.

36. A tile of claim 1 have a surface face that is a textured surface.

37. A tile of claim 36 wherein:

the textured surface includes outwardly extending projections selected from the group consisting of pyramids having peaks, cubes having outwardly facing surfaces, waves having ridges, and combinations thereof; and the depth of depressions between the projections is not more than 60% of the distance between peaks, surfaces, or ridges.

38. An array of tiles wherein:

the array comprises plural tiles of claim 1 arranged edge-to-edge with the major surface face of one tile generally aligned with the minor surface face of an abutting tile; and a ledge of the one tile overlies a ledge of the abutting tile.

39. The array of tiles of claim 38 wherein at least two of the abutting tiles having overlying ledges are:

identical in shape; and in reversed orientation with their respective major and minor surface faces facing in opposite directions.

40. The array of tiles of claim 38 wherein at least two of the abutting tiles having overlying ledges are not identical in shape.

41. An array of claim 38 wherein the ledges are shaped so that plural tiles fit together edge-to-edge with the major and minor surface faces of one tile generally aligned respectively with the minor and major surface faces of an abutting tile and with a ledge of the one tile overlying the ledge of the abutting tile, with only a portion of the thickness of each tile overlapping.

42. An array of claim 38 wherein there are no straight-through gaps between abutting tiles.

43. A barrier for inhibiting penetration of ballistic projectiles, the barrier comprising an array of claim 38.

44. A body armor garment configured to be worn by a human, the garment comprising an array of claim 38.

* * * * *